US005175055A

United States Patent [19]

Tsukahara et al.

[11] Patent Number: 5,175,055

[45] Date of Patent: Dec. 29, 1992

[54] THERMAL TRANSFER INK AND TRANSFER MEDIUM

[75] Inventors: Michinari Tsukahara; Makoto Taniguchi, both of Nagano, Japan

[73] Assignee: Seiko Epson Corporation, Tokyo, Japan

[21] Appl. No.: 400,613

[22] Filed: Aug. 30, 1989

[30] Foreign Application Priority Data

| | | | |
|---|---|---|---|
| Aug. 30, 1988 | [JP] | Japan | 63-215639 |
| Dec. 13, 1988 | [JP] | Japan | 63-314263 |
| Jan. 30, 1989 | [JP] | Japan | 63-20114 |

[51] Int. Cl.[5] ..... B41M 5/26

[52] U.S. Cl. ..... 428/412; 427/146; 428/195; 428/413; 428/423.1; 428/474.4; 428/480; 428/497; 428/500; 428/522; 428/913; 428/914

[58] Field of Search ..... 428/195, 212, 480, 481, 428/484, 486, 488.1, 448.4, 497, 498, 500, 503, 507, 511, 524, 530, 537.5, 412, 413, 423.1, 474.4, 522, 913, 914; 427/146

[56] References Cited

U.S. PATENT DOCUMENTS

| | | | |
|---|---|---|---|
| 4,503,095 | 3/1985 | Seto | 427/265 |
| 4,636,258 | 1/1987 | Hayashi | 106/31 |
| 4,983,446 | 1/1991 | Taniguchi et al. | 428/195 |

FOREIGN PATENT DOCUMENTS

| | | |
|---|---|---|
| 138685 | 8/1983 | Japan . |
| 129195 | 7/1984 | Japan . |

*Primary Examiner*—Pamela R. Schwartz
*Attorney, Agent, or Firm*—Blum Kaplan

[57] ABSTRACT

A thermal transfer ink composition including a first component not having a distinct melting point below about 200° C. The first component can be present as about 5 to 75% of the ink composition. The ink composition also preferably includes a second component having a melting point below about 200° C. and colorant. The ink is highly resistant to extended exposure to high heat and high humidity and is capable of providing color printing with excellent color gradation and a broad range of color as well as providing a color image having a smooth look and feel. A thermal transfer ink medium includes the ink composition coated on a thin film support. The optical density of ink transferred from the medium is linearly proportional to printing energy supplied to the transfer medium.

16 Claims, 5 Drawing Sheets

FIG. 3
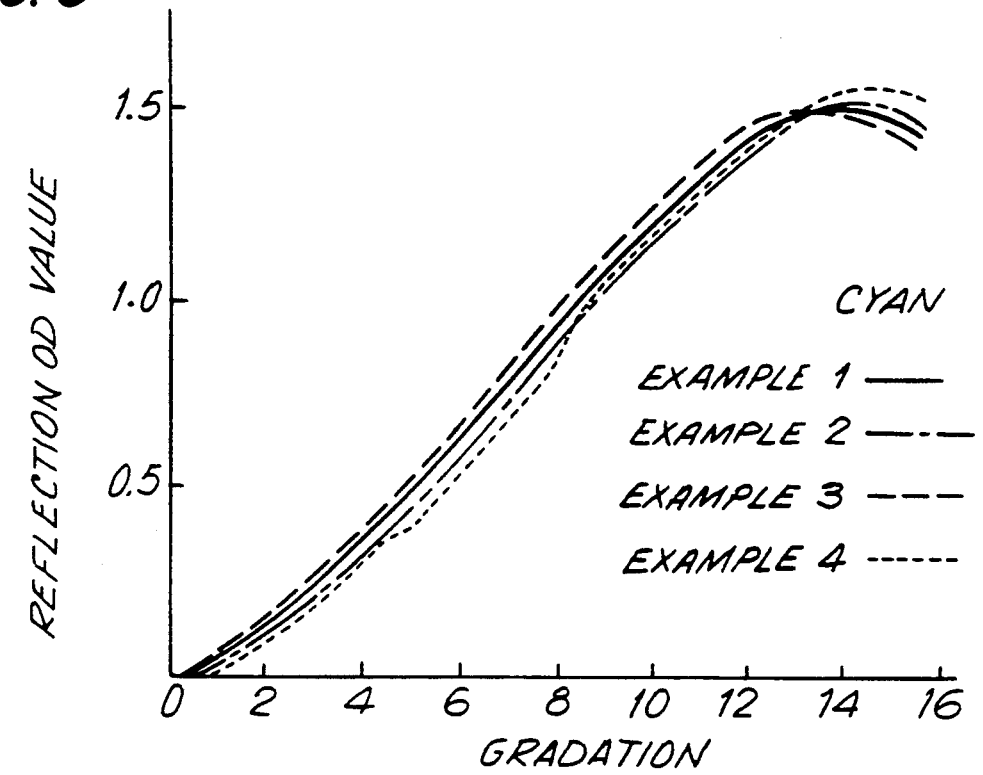
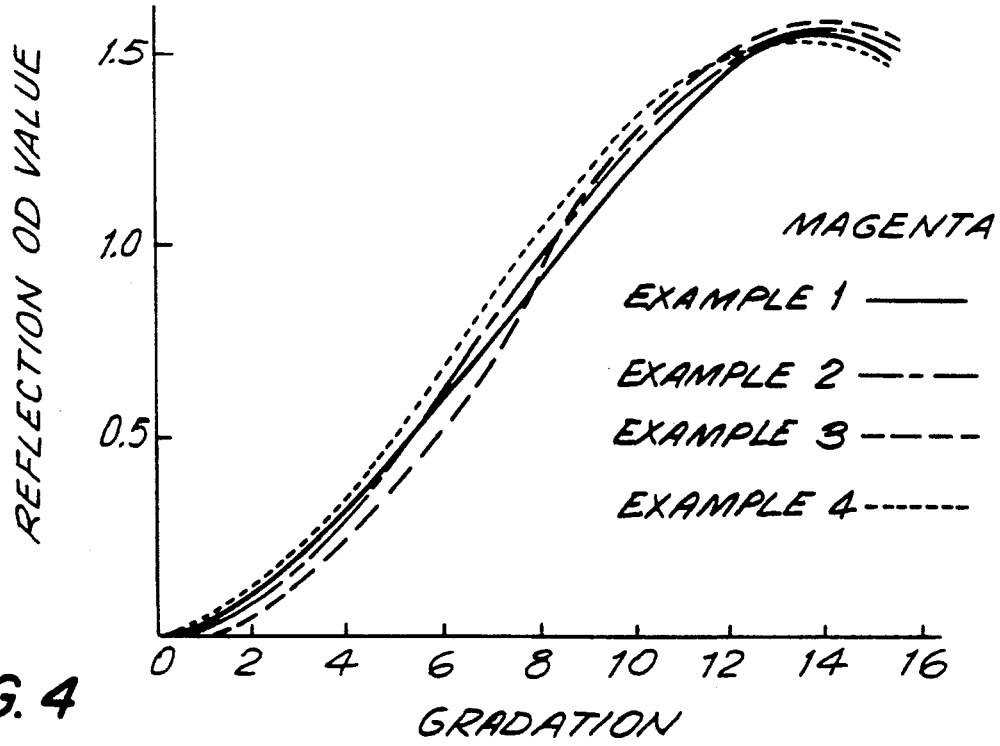
FIG. 4

FIG. 5
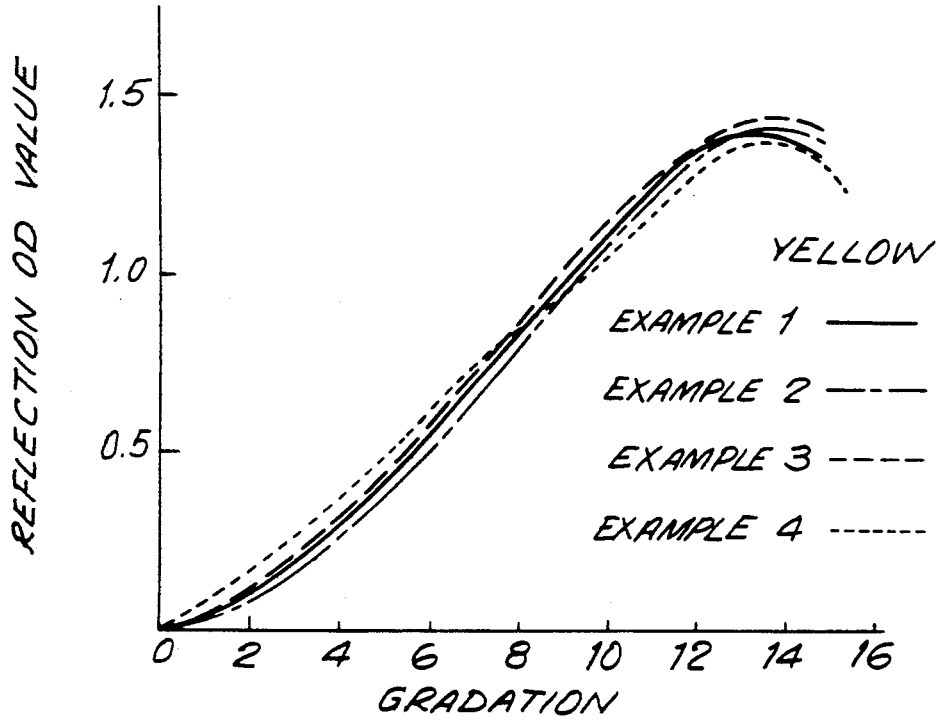
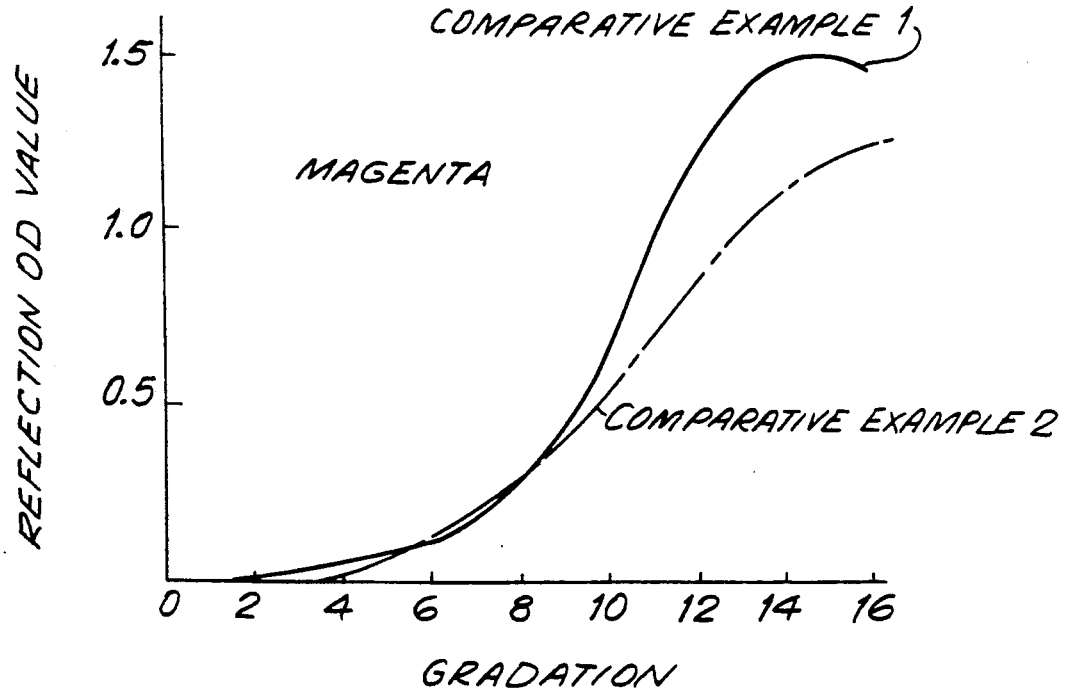
FIG. 6

FIG. 7
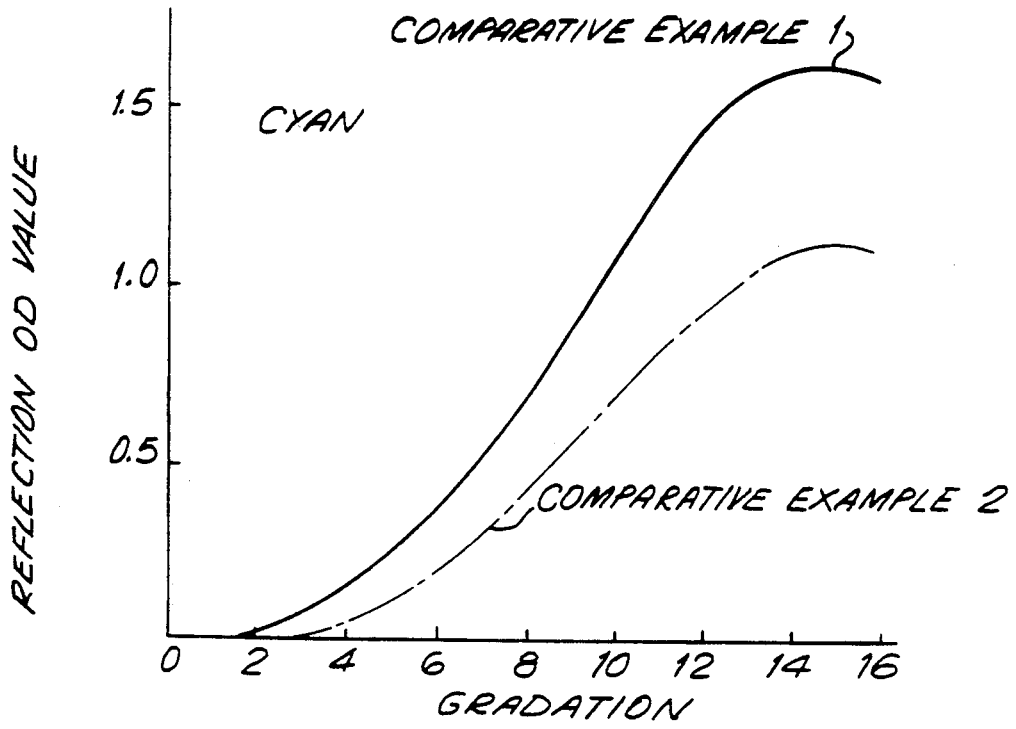
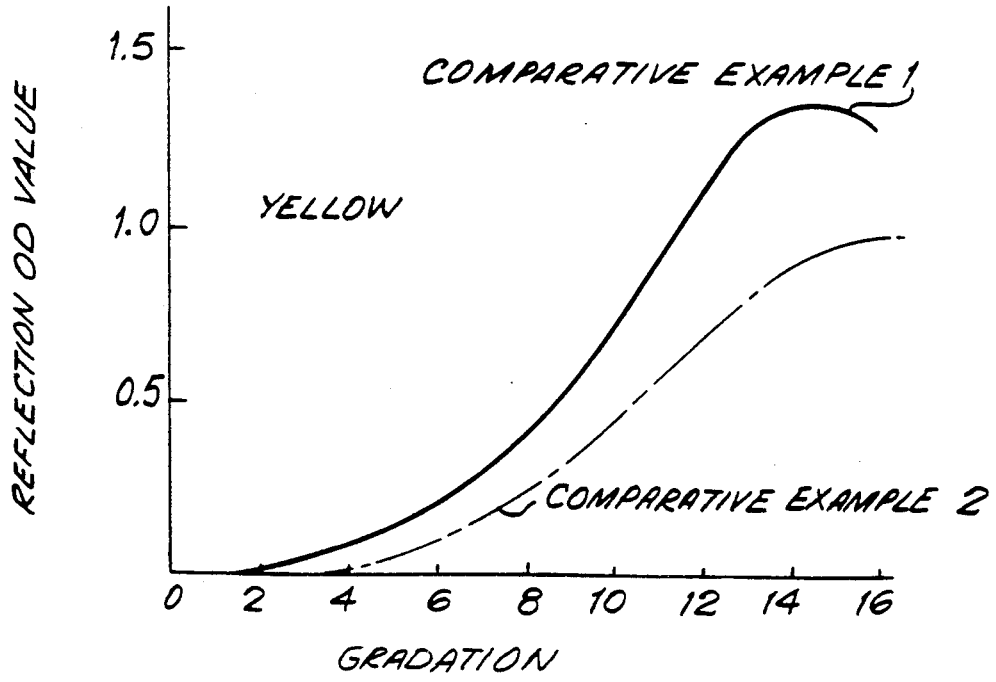
FIG. 8

THERMAL TRANSFER INK AND TRANSFER MEDIUM

BACKGROUND OF THE INVENTION

The invention relates generally to a thermal transfer ink and more particularly to a thermal transfer ink and transfer medium for use with a thermal transfer printing apparatus in which selected variations in the heat generated by a thermal print head of the printing apparatus can create selected gradations in print density of printed dots of ink.

Thermal transfer ink media for use with conventional thermal transfer printers commonly include a uniform ink layer disposed on a heat resistant support layer. Conventional thermal transfer printing and thermal transfer ink media are discussed in U.S. Pat. No. 4,503,095, the contents of which are hereby incorporated herein by reference. Heat from a thermal print head corresponding to a printing signal selectively melts portions of the ink layer and transfers dots of ink from the transfer medium to a recording medium, such as paper, in a sensitive manner with high reproducibility.

Conventional thermal transfer inks typically include a binder having a melting point in the range of between about 50° C. to 100° C., or about the same melting point range of the ink and are compatible therewith for satisfying the performance requirements of the ink. The ink typically includes a colorant, such as a pigment or dye which is mixed with the binder such as by heat kneading and the mixture is disposed on a support by hot melt coating, solvent dispersion, solvent coating or emulsion coating.

Because conventional inks typically melt in the range of 50° C. to 100° C., conventional thermal transfer inks and thermal transfer ink media have inadequate resistance to prolonged exposure to high temperature and high humidity. This can lead to undesirable softening of the ink layer and to the undesirable blocking phenomenon and other undesirable staining.

When conventional multi-color ink transfer media are prepared, such as three color ink media that include yellow, magenta and cyan color bands for printing full color images by successive thermal transfer, the print density gradation of the transferred ink is inadequate. As a result, too much or too little ink is transferred and there is no adequate method for controlling color gradations and densities. This leads to unclear images and an inadequate range of colors. Thus, these conventional thermal transfer inks and thermal transfer ink media are not fully satisfactory.

Accordingly, it is desirable to provide a thermal transfer ink and ink media which avoid the shortcomings of the prior art and can provide clear uniform characters, broad color reproducing range when printing color images by the successive multi-color method and images with superior color gradations while resisting the deleterious effects of exposure to high heat and high humidity.

SUMMARY OF THE INVENTION

Generally speaking, in accordance with the invention, a thermal transfer ink including a first organic component not having a sharp melting point at a temperature below about 200° C. The first component is preferably present as between about 5 to 70 weight present of the ink composition. The ink can also include a second organic component having a melting point lower than about 200° C. and a colorant. The optical density of material printed from the ink medium is directly linearly proportional to printing energ supplied to the ink medium.

Accordingly, it is an object of the invention to provide a thermal transfer ink and a thermal transfer ink medium.

Another object of the invention is to provide a ink composition and transfer medium capable of providing uniform color gradations in linear proportion to selectively varying heat from a print head.

A further object of the invention is to provide a thermal transfer ink and ink medium having high resistance to extended exposure to high temperatures and high humidities.

Still another object of the invention is to provide a multi-color thermal transfer ink medium capable of producing a large number of color gradations.

Still other objects and advantages of the invention will in part be obvious and will be in part be apparent from the specification and drawings.

The invention accordingly comprises a composition of matter and transfer medium possessing the characteristics, properties, and the relation of constituents which will be exemplified in the compositions hereinafter described, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is a graph showing the relationship between the printing energy and transfer density illustrating the gradation property of a magenta ink printed as the first color in accordance with the invention;

FIG. 4 is a graph showing the relationship between the printing energy and transfer density illustrating the gradation property of a cyan ink printed as the second color in accordance with the invention;

FIG. 5 is a graph showing the relationship between the printing energy and transfer density illustrating the gradation property of a yellow ink printed as the third color in accordance with the invention;

FIG. 6 is a graph showing the relationship between the printing energy and transfer density illustrating the gradation property of a magenta ink printed as the first color as a comparative example;

FIG. 7 is a graph showing the relationship between the printing energy and transfer density illustrating the gradation property of a cyan ink printed as the second color as a comparative example;

FIG. 8 is a graph showing the relationship between the printing energy and transfer density illustrating the gradation property of a yellow ink printed as the third color as a comparative example.

DETAILED DESCRIPTION OF THE PREFERRED EMBODIMENTS

Figure 1:
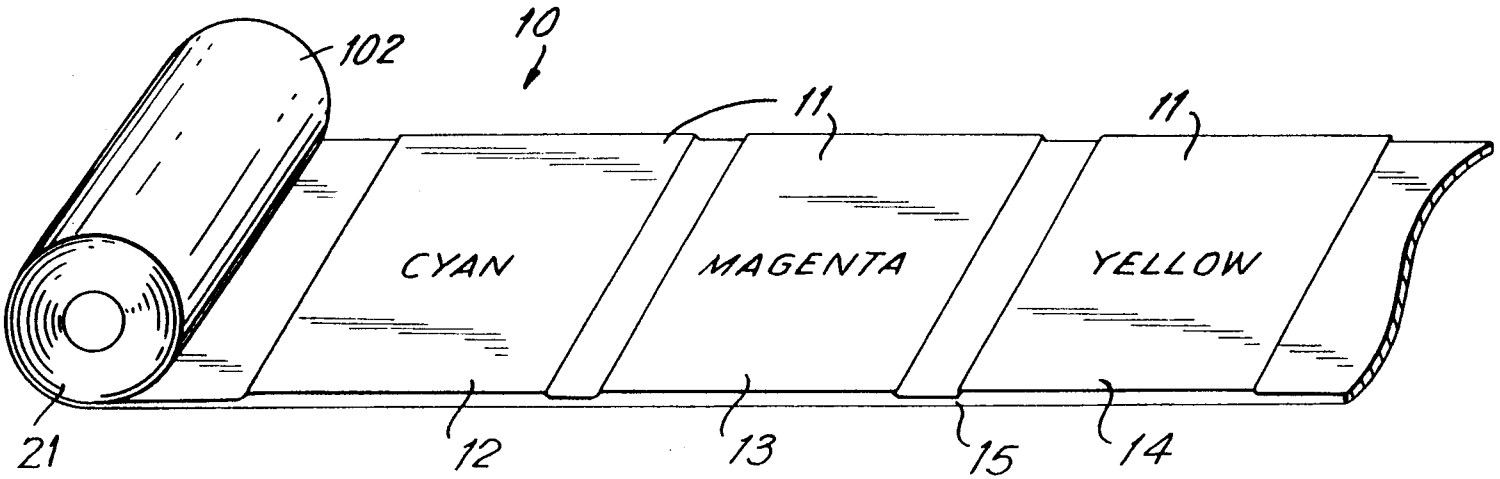
FIG. 1 is a perspective view of a three color thermal transfer ink medium formed in accordance with the invention.

A thermal transfer ink composition for use in a thermal transfer ink media prepared in accordance with the invention includes at least three components. The first component is an organic material that does not have a distinct melting point at temperatures below about 200° C. The second component is an organic material that has a distinct melting point below 200° C.; and the third component is a colorant. The first organic component is preferably a resin, such as a polystyrene resin and is preferably included in the ink composition in an amount ranging from about 5 to 70%, based on the total weight of the ink composition. By including differently colored material within different regions of the ink layer, a multi-color thermal transfer ink sheet can be prepared in accordance with the invention. Alternatively, multicolor printing can be performed by successive ink transfers from a plurality of differently colored mono-color thermal transfer ink sheets.

The ink composition preferably includes between about 60 to 95% of the first and second organic components. For certain applications, of the ink composition. 20 to 50 wt % of the first organic component is preferable. It is also often preferable to include 20 to 70% of the second component.

The colorant or coloring agent is present between about 1 to 40 weight percent and preferable between 5 and 15 weight percent of the ink composition.

Thermal transfer ink and thermal transfer ink media prepared in accordance with the invention will now be described with reference to the following examples. These examples are presented for purposes of illustration only and are not intended to be construed in a limiting sense.

Tables 1-4, below, correspond to Examples 1-4 of thermal transfer inks prepared in accordance with the invention. Tables 5 and 6 show examples of conventional thermal transfer ink for purposes of comparison. The percentages of material referred to in the tables are all on a weight basis, based on the total weight of the composition. The first organic component that does not have a distinct melting point below 200° C. is prefaced by the letter A in the tables. The second organic component having a melting point below 200° C. is indicated by the letter B.

The following abbreviations are included within the tables:

A: does not have a melting below 200° C.

B: melting below 200° C.

EVA: ethylene—vinyl acetate copolymer

EEA: ethylene—ethylacrylate copolymer

MA copolymer: α—olefin/maleic acid anhydride copolymer

Comparative Example 1 shown in Table 5 includes organic materials having a melting point below 200° C., except for the colorants. As shown in Table 6, Comparative Example 2 includes compositions in which more than 70% (actually 75%) of the organic materials did not have a distinctive melting point at a temperature below 200° C., except for the colorants.

EXAMPLE 1

TABLE 1

| Ingredient (weight %) | | Yellow | Magenta | Cyan |
|---|---|---|---|---|
| Hansa Yellow-G | | 10 | | |
| Brilliant Carmine 6B | | | 10 | |
| Phthalocyanine Blue | | | | 10 |
| A | Polystyrene | 25 | 25 | 25 |
| | Polyester | | | |
| | Vinyl chloride - vinyl acetate copolymer | | | |
| | EVA | | | |
| | EEA | | | |
| B | Carnauba wax | 30 | 30 | 30 |
| | Microcrystalline wax | | | |
| B | Paraffin wax | 20 | 20 | 20 |
| | Polyethylene wax | | | |
| B | MA copolymer | 15 | 15 | 15 |
| | Total | 100 wt. % | 100 wt. % | 100 wt. % |

EXAMPLE 2

TABLE 2

| Ingredient (weight %) | | Yellow | Magenta | Cyan |
|---|---|---|---|---|
| Hansa Yellow-G | | 10 | | |
| Brilliant Carmine 6B | | | 10 | |
| Phthalocyanine Blue | | | | 10 |
| | Polystyrene | | | |
| A | Polyester | 30 | 30 | 30 |
| | Vinyl chloride - vinyl acetate copolymer | | | |
| | EVA | | | |
| | EEA | | | |
| | Carnauba wax | | | |
| B | Microcrystalline wax | 30 | 30 | 30 |
| B | Paraffin wax | 20 | 20 | 20 |
| | Polyethylene wax | | | |
| B | MA copolymer | 10 | 10 | 10 |
| | Total | 100 wt. % | 100 wt. % | 100 wt. % |

EXAMPLE 3

TABLE 3

| Ingredient (weight %) | | Yellow | Magenta | Cyan |
|---|---|---|---|---|
| Hansa Yellow-G | | 10 | | |
| Brilliant Carmine 6B | | | 10 | |
| Phthalocyanine Blue | | | | 10 |
| | Polystyrene | | | |
| | Polyester | | | |
| A | Vinyl chloride - vinyl acetate copolymer | 25 | 25 | 25 |
| A | EVA | 15 | 15 | 15 |
| | EEA | | | |
| | Carnauba wax | | | |
| B | Microcrystalline wax | 20 | 20 | 20 |
| B | Paraffin wax | 20 | 20 | 20 |
| B | Polyethylene wax | 10 | 10 | 10 |
| | MA copolymer | | | |
| | Total | 100 wt. % | 100 wt. % | 100 wt. % |

EXAMPLE 4

TABLE 4

| Ingredient (weight %) | | Yellow | Magenta | Cyan |
|---|---|---|---|---|
| Hansa Yellow-G | | 10 | | |
| Brilliant Carmine 6B | | | 10 | |
| Phthalocyanine Blue | | | | 10 |
| A | Polystyrene | 25 | 25 | 25 |
| | Polyester | | | |
| | Vinyl chloride - vinyl acetate copolymer | | | |

TABLE 4-continued

| Ingredient (weight %) | | Yellow | Magenta | Cyan |
|---|---|---|---|---|
| | EVA | | | |
| A | EEA | 10 | 10 | 10 |
| | Carnauba wax | | | |
| B | Microcrystalline wax | 20 | 20 | 20 |
| | Paraffin wax | | | |
| B | Polyethylene wax | 20 | 20 | 20 |
| B | MA copolymer | 15 | 15 | 15 |
| | Total | 100 wt. % | 100 wt. % | 100 wt. % |

COMPARATIVE EXAMPLE 1

TABLE 5

| Ingredient (weight %) | | Yellow | Magenta | Cyan |
|---|---|---|---|---|
| Hansa Yellow-G | | 10 | | |
| Brilliant Carmine 6B | | | 10 | |
| Phthalocyanine Blue | | | | 10 |
| | Polystyrene | | | |
| | Polyester | | | |
| | Vinyl chloride - vinyl acetate copolymer | | | |
| | EVA | | | |
| | EEA | | | |
| B | Carnauba wax | 20 | 20 | 20 |
| B | Microcrystalline wax | 20 | 20 | 20 |
| B | Paraffin wax | 10 | 10 | 10 |
| B | Polyethylene wax | 15 | 15 | 15 |
| B | MA copolymer | 25 | 25 | 25 |
| | Total | 100 wt. % | 100 wt. % | 100 wt. % |

COMPARATIVE EXAMPLE 2

TABLE 6

| Ingredient (weight %) | | Yellow | Magenta | Cyan |
|---|---|---|---|---|
| Hansa Yellow-G | | 10 | | |
| Brilliant Carmine 6B | | | 10 | |
| Phthalocyanine Blue | | | | 10 |
| A | Polystyrene | 25 | 25 | 25 |
| A | Polyester | 30 | 30 | 30 |
| | Vinyl chloride - vinyl acetate copolymer | | | |
| | EVA | | | |
| A | EEA | 20 | 20 | 20 |
| | Carnauba wax | | | |
| | Microcrystalline wax | | | |
| B | Paraffin wax | 5 | 5 | 5 |
| B | Polyethylene wax | 5 | 5 | 5 |
| B | MA copolymer | 5 | 5 | 5 |
| | Total | 100 wt. % | 100 wt. % | 100 wt. % |

The thermal transfer inks described in the tables were prepared as follows. The components for the ink compositions were admixed in a solvent selected to dissolve or uniformly disperse the components and the mixture was then stirred. The colorant was added and dispersed over several hours of stirring to yield a uniform ink composition. The ink was coated on a support film and dried to yield a thermal transfer ink medium.

In addition to this solvent method, thermal transfer inks and media in accordance with the invention can be formed by hot melt methods, emulsion methods and other appropriate methods. As shown in FIG. 1, an ink sheet 10 prepared by coating and drying a 1-3 μm thick ink layer 11 formed on a support film 15. Ink layer 11 includes a cyan ink region 12, a magenta ink region 13 and a yellow ink region 14. Support film 15 is a 6 μm thick film of polyethylene terephthalate (PET).

Examples of acceptable solvents for coating the ink in accordance with the invention by the solvent coating method include organic solvents such as toluene, methyl ethyl ketone, tetrahydrofuran, acetone, methyl isobutyl ketone, cyclohexanone, butyl acetate, ethyl acetate, ethanol, methanol and carbon tetrachloride or water, either alone or in combination.

Examples of organic materials which does not have a melting below about 200° C. to be included as the first organic component in accordance with the invention include those listed in the tables and acrylic resins, polyurethane, polyvinyl acetal, polyamide including nylon, rosin resin, polyethylene, polycarbonate, vinylidene chloride resin, polyvinyl alcohol, cellulose resins, epoxy resins, vinyl acetate resin and vinyl chloride resin.

Organic materials well suited for inclusion as the second component of the ink composition having a melting point below about 200° C. include those listed in the tables and montan wax, alcohol wax, synthetic oxide wax, lanolin and another plant and animal waxes and the like.

In addition to the organic pigments listed in the tables, the colorant to be included in ink formed in accordance with the invention can include inorganic pigments, dyes, carbon black and the like.

Figure 2:
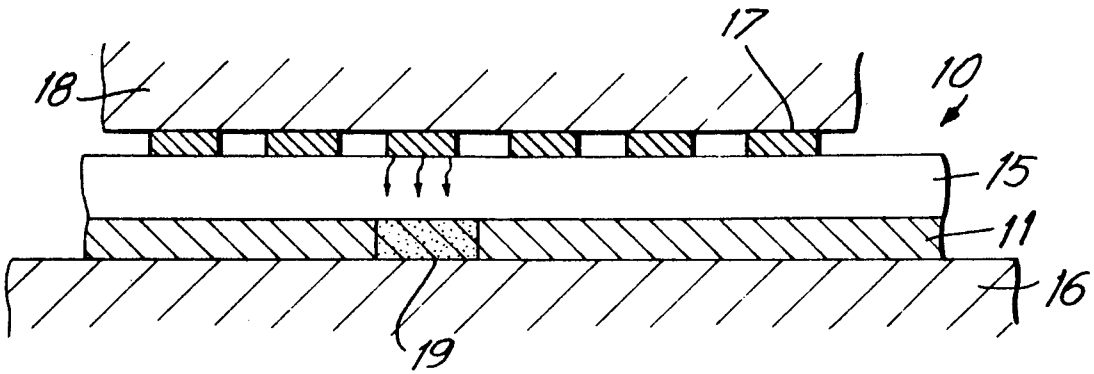
FIG. 2 is a cross-sectional view illustrating the transfer of a dot ink from a thermal transfer ink medium to a recording medium.

A printing test was conducted to evaluate the printing ability of thermal transfer medium 10 by printing as shown in FIG. 2. Ink layer 11 of medium 10 was contacted to a recording paper 16 and a plurality of heating elements 17 of a print head 18 were placed against support layer 15 of thermal transfer medium 10. Heat was transferred from heating elements 17, through support layer 15, into ink layer 11 in accordance with printing signals to melt a portion 19 of ink layer 11 to transfer ink from ink layer 11 to paper 16. Transfer medium 10 was removed and non-recorded portions of ink layer 11 were removed therewith, leaving selected dots of ink that formed a printed pattern.

A 16 step lateral stripe density gradation pattern was printed on smooth paper. The printing energy was controlled to be at a minimum for the first minimum density step, to provide the maximum printing density at the 14th step and to provide excess energy for the 15th and 16th steps. The transfer density of each step was measured with a Macbeth-TR-927 optical density testing device, manufactured by Kollmorgan Co., to provide a reflection optical density value with a complimentary color filter and the results are illustrated in FIGS. 3–8.

As shown in FIGS. 3–5, the thermal transfer inks of Examples 1–4, formed in accordance with the invention, exhibited an excellent gradual. There was a linear increase in optical printing density directly proportional to increased printing energy from a low energy low printing density step 1 to a high energy high density step 14 without background contamination or ink flow caused by the high heat required for high density printing.

As shown in FIGS. 6–8, the ink prepared for Comparative Examples 1 and 2 yielded a nonlinear increase in optical density. The increase in optical density was initially very slow, until about the 7th step and then extremely rapid until about the 12th step at which point it levelled out. Ink of Comparative Example 2 exhibited poor transfer efficiency and failed to achieve adequate optical density. The of Comparative Example 1 caused background contamination over portions of the entire surface to be printed and ink began to flow during high energy, high density printing.

Full color images were prepared by superimposing images formed by three differently colored ink layers and 64 optical density gradations for each of the colors. The six thermal transfer inks prepared in accordance with the invention, described in Examples 1–4 were used. Images obtained by printing with inks from examples 1–4 exhibited an excellent broad color range and were both smooth and clear. The images obtained by printing with the inks of Comparative Examples 1 and 2 exhibited a narrower color range as well as inferior printing quality. These had a rough feel due to jumps in printing density, ink flow, background contamination and insufficient printing density.

A stain resistance test was conducted for the ink compositions of Examples 1–4 and Comparative Examples 1 and 2. The test was conducted by wrapping thermal transfer sheets, similar to thermal transfer ink medium 10, around a 20 mm diameter core in the form a roll 21 shown in FIG. Roll 21 was exposed to a temperature of 50° C. at a humidity of 90% for one week. The amount of ink transferred the rear surface 15' of film 15 was examined with a microscope. Transfer of ink to rear surface 15' did not occur when transfer medium 10 was prepared with ink of Examples 1–4 and Comparative Example 2. However, ink transferred to rear surface 15' when the transfer medium was prepared using ink of Comparative Example 1.

Figure 9:
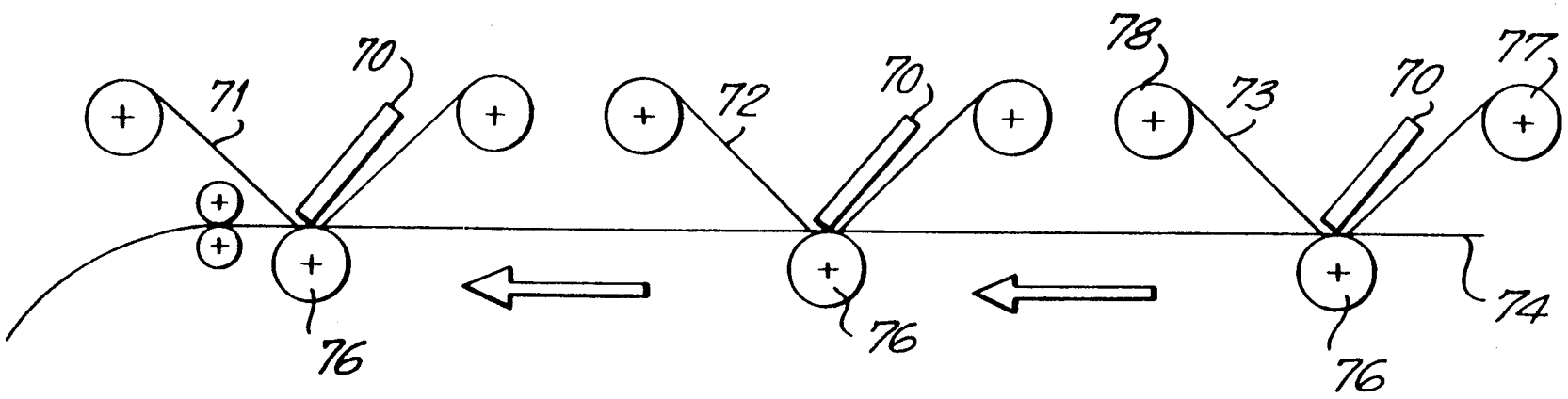
FIG. 9 is a schematic elevational view illustrating a multi-color printing apparatus using mono-color thermal transfer media for each of yellow, magenta and cyan.

FIG. 9 shows another example of multi-color printing with a plurality of thermal transfer media 2 in accordance with the invention. Three print heads 70 and three mono-color thermal transfer media including a cyan transfer medium 71, a magenta transfer medium 72 and a yellow transfer medium 73 are employed to transfer ink to a recording paper 74 transported on a series of rollers 76 corresponding to selected application of heat from print heads 70. The mono-color ink transfer media are fed from feed roll 77 to a take up roll 78 after passing between head 70 and paper 74.

By including material that does not have a distinct melting point at a temperature below 200° C. in the ink layer of the thermal transfer medium, the ink composition exhibits excellent resistance to high temperature and high humidity. In addition, the ink prepared in accordance with the invention exhibits an excellent gradation from low to high optical density in response to selectively varying the printing energy. This leads to images having improved print density gradation and improves the quality of images printed by superimposing differently colored images. Accordingly, clear images having a broad range of colors and an acceptable surface are obtained.

Although the invention has been described with reference to printing by superimposing images from three color ink sheets with a thermal print head, the inks in accordance with the invention are also applicable to other thermal transfer methods and apparatuses such as an electric-supply heat transfer system. The invention is also not restricted to providing color images with the colors of yellow, magenta and cyan and is also applicable to other color systems such as four color printing that includes black colored inks or mono-color or bi-color printing. These thermal transfer ink and thermal transfer medium can provide resistance to high temperatures and humidities and provide excellent color gradations and densities to yield high quality images having a broad range of colors.

It will thus be seen that the objects set forth above, among those made apparent from the preceding description, are efficiently attained and, since certain changes may be made in the above composition of matter and in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A thermal transfer ink medium, comprising:

a support layer;

an ink layer disposed on the support layer, the ink layer having a composition comprising a first organic component not having a melting point below about 200° C. and present in the ink composition in an amount between 5 to 70 wt. %, based on the total weight of the ink composition and colorant.

2. The thermal transfer ink medium of claim 1, wherein the first component is present in the ink composition in an amount between about 20 to 50 wt. %, based on the total weight of the ink composition.

3. The thermal transfer ink medium of claim 2, the ink further comprising a second organic component having a melting point below about 200° C.

4. The thermal transfer ink medium of claim 3, wherein the first component is selected from the group consisting of polystyrene, polyester, vinyl chloride-vinyl acetate copolymer, ethylene-vinyl acetate copolymer, ethylene ethylacrylate copolymer and combinations thereof.

5. The thermal transfer ink medium of claim 1, wherein the first component is selected from the group consisting of polystyrene, polyester, vinyl chloride-vinyl acetate copolymer, ethylene-vinyl acetate copolymer, ethylene ethylacrylate copolymer, acrylic resins polyurethane polyvinyl acetal, polyamide, rosin resin, polyethylene, polycarbonate, vinylidene chloride resin, polyvinyl alcohol, cellulose resins, epoxy resins, vinyl acetate resin, vinyl chloride resin and combinations thereof.

6. The thermal transfer ink medium of claim 1, wherein the first component is polystyrene resin.

7. A method of forming a thermal transfer ink medium capable of producing linear increases in optical printing density with linear increases in printing energy, comprising:

admixing a first organic component not having a melting point below about 200° C., and present in the ink composition in an amount between 5 to 70 wt. %, based on the total weight of the ink composition, a second organic component comprising wax material having a melting point below about 200° C. and colorant to form a uniform mixture thereof; and disposing the uniform mixture of the first component, second component and colorant on a support film.

8. The method of claim 7, wherein the ink composition comprises about 20 to 50 wt. % of the first organic component.

9. The method of claim 8, wherein the first organic component is selected from the group consisting of polystyrene, polyester, vinyl chloride-vinyl acetate copolymer, ethylene-vinyl acetate copolymer, ethylene ethylacrylate copolymer and combinations thereof.

10. The method of claim 7, wherein the first organic component is selected from the group consisting of polystyrene, polyester, vinyl chloride-vinyl acetate copolymer, ethylene-vinyl acetate copolymer, ethylene ethylacrylate copolymer, acrylic resins, polyurethane, polyvinyl acetal, polyamide, rosin resin, polyethylene, polycarbonate, vinylidene chloride resin, polyvinyl alcohol, cellulose resins, epoxy resins, vinyl acetate resin, vinyl chloride resin and combinations thereof.

11. A thermal transfer ink medium, comprising:

a support layer;

an ink layer disposed on the support layer, the ink layer comprising colorant, a first organic component which does not have a melting point below about 200° C. and present in the ink composition in an amount between 5 to 70 wt. %, based on the total weight of the ink composition and a second component of a different composition than the first component, the second component comprising wax material and having a melting point below about 200° C.

12. The thermal transfer ink medium of claim 11, wherein the first component comprises polystyrene.

13. The thermal transfer ink medium of claim 11, wherein the first component comprises vinyl chloride-vinyl acetate copolymer.

14. The thermal transfer ink medium of claim 11, wherein the first component comprises ethylene-vinyl acetate copolymer.

15. The thermal transfer ink medium of claim 11, wherein the first component comprises ethylene-ethylacrylate copolymer.

16. The thermal transfer ink medium of claim 11, wherein the second component comprises a member selected from the group consisting of carnauba wax, microcrystalline wax, paraffin wax, polyethylene wax, α-olefin/maleic acid anhydride copolymer, and combinations thereof.

* * * * *